US006237887B1

(12) United States Patent
Banner

(10) Patent No.: US 6,237,887 B1
(45) Date of Patent: May 29, 2001

(54) FOLDING STAND FOR SHEET MUSIC OR OTHER READING OR VISUAL MATERIAL

(76) Inventor: Daniel M. Banner, 464 Funston Ave., San Francisco, CA (US) 94118

( * ) Notice: Subject to any disclaimer, the term of this patent is extended or adjusted under 35 U.S.C. 154(b) by 0 days.

(21) Appl. No.: 09/351,922

(22) Filed: Jul. 12, 1999

Related U.S. Application Data

(63) Continuation-in-part of application No. 08/825,176, filed on Mar. 27, 1997.

(51) Int. Cl.[7] ..... A47B 97/08; G09F 1/00

(52) U.S. Cl. ..... 248/459; 40/124.09; 40/124.19

(58) Field of Search ..... 248/459, 454, 248/455, 456, 460, 178, 457; 40/124.09, 124.16, 124.17, 121.191, 124.19

(56) References Cited

U.S. PATENT DOCUMENTS

| | | | | |
|---|---|---|---|---|
| 1,750,528 | * | 3/1930 | Krebs | 248/459 |
| 2,581,733 | * | 1/1952 | Trask | 248/459 |
| 2,587,316 | * | 2/1952 | Henry | 248/459 |
| 2,654,554 | * | 10/1953 | Cross | 248/459 |
| 4,318,527 | * | 3/1982 | Smith | 248/459 |
| 4,436,271 | * | 3/1984 | Manso | 248/460 |
| 4,610,417 | * | 9/1986 | Kuss | 248/460 |
| 5,290,002 | * | 3/1994 | Cohen | 248/456 |
| 5,607,135 | * | 3/1997 | Yamada | 248/456 |
| 5,624,096 | * | 4/1997 | Haynes | 248/451 |
| 5,722,628 | * | 3/1998 | Menaged | 248/459 |
| 5,782,452 | * | 7/1998 | Bosworth | 248/459 |
| 5,810,316 | * | 9/1998 | Eby | 248/451 |
| 5,829,729 | * | 11/1998 | Welch et al. | 248/459 |
| 5,941,496 | * | 8/1999 | Banner | 248/459 |

* cited by examiner

*Primary Examiner*—Leslie A. Braun
*Assistant Examiner*—Jon Szumny
(74) *Attorney, Agent, or Firm*—Johnson & Steinbrook, LLP; Lorry D. Johnson; Craig M. Steinbrook

(57) ABSTRACT

A lightweight, folding copy stand, also of use as a sheet music holder or a book holder, comprised of a plurality of panels and hinges arranged such that the stand is erected with a minimum of steps and with desirable rigidity. The stand is also returned to a folded position with minimal effort and with a minimum of steps. When the stand is in its operational configuration, the plurality of panels and hinges form a support member, a shelf, an angular portion, and feet members. The angular portion and feet members may be integrally formed. When closed, the support member and shelf fold to form two exterior panels enclosing the feet members and defining an exterior surface area approximately one-half the size of the support member and four panels in thickness. In its closed configuration, the stand is approximately the size and weight of a typical magazine.

10 Claims, 5 Drawing Sheets

FOLDING STAND FOR SHEET MUSIC OR OTHER READING OR VISUAL MATERIAL

This application is a Continuation-in-Part of application Ser. No. 08/825,176, filed Mar. 27, 1997, by applicant herein.

BACKGROUND OF THE INVENTION

1. Field of the Invention

The present invention relates to folding copy stands suitable for use in supporting sheet music, a book, or other reading or visual material, in an essentially upright position. More particularly, the present invention is directed to a highly portable copy stand that may be erected and disassembled in a minimum number of steps.

2. Description of the Prior Art

The prior art is populated with various kinds of portable and collapsible supports, book holders, sheet music and copy stands, and display easels and mounts. One of the objectives of such devices is to provide a relatively portable apparatus which will support reading or visual material in an essentially upright position without the need for the viewer to hold or brace the material with his or her hands. Prior art devices meet this objective with varying degrees of success. However, while many of the known devices are designed to fold for ease of transport and storage, the devices in the prior art are nonetheless deficient in many ways. The subject invention is designed to suit the many purposes of such a device. Further, it is designed to improve on the operational rigidity of such devices and to increase the ease and convenience of use, transportation, and storage. Thus, while the range of possible uses of the present invention is broad, it is especially well suited for use as a copy stand, sheet music holder, or book holder, and more particularly well suited to meet the needs of musicians, students, computer operators, typists, and other possible users who routinely travel to work away from the home or office.

Representative book holder devices in the prior art include U.S. Pat. No. 5,029,798 (Clark), which discloses a portable book stand fabricated from a planar panel of substantially rigid material. The stand includes a book support surface, a shelf extending outwardly from that surface and a plurality of tab-like support members which function as supports for the shelf and the support surface. Each of the supports are in turn supported by auxiliary tab-like supports which retain them in position.

U.S. Pat. No. 4,610,416 (Choi) discloses a foldable book stand comprising front and rear surfaces, the front surface having substantially parallel transverse crease lines across the lower portion. The front surface folds in on itself in opposite directions along the crease lines, and the rear surface has triangular lateral flanges which are extended from the rear surface along a horizontal crease line. The lateral flanges contain slots and the transverse support member contains end tabs for engaging in the slots, so that the book stand is readily convertible from a flat folded state to an assembled state.

U.S. Pat. No. 4,555,128 (White) discloses a device for use as a reading stand or writing support surface. It includes a base panel, an upper support panel, a hinge connecting one side of the two panels, and an elastic band page holder for holding the pages of a book open against the support panel.

U.S. Pat. No. 4,460,146 (Raggiotti) discloses a portable reading desk formed from a single piece of thin, flat, generally rectangular stock which is cut and creased into three portions that can be folded either flat for travel or into a three dimensional configuration for supporting reading material.

U.S. Pat. No. 4,318,527 (Smith) discloses a collapsible support structure for use as an easel or book support. It is self-supporting in its fully erect configuration, presenting a plurality of forwardly facing panels which stand in a slightly inclined or substantially vertical fashion, and a forwardly extending ledge extending from the bottom portion of the support panels, which ledge rests flat on an underlying surface.

U.S. Pat. No. 2,803,076 (Viglietta) discloses a foldable or collapsible display device comprising transverse fold lines which form three foldable sections, including a foldable base. The base of the device has lockable flaps that may be folded and snapped into notches for locking the base at a suitable angle to the main upright support portion of the display. The rear surfaces of the two upright sections of the display include a stiffening member with a longitudinal fold line, and the stiffening member extends laterally out and away from the rear surface of the panels to provide structural reinforcement.

U.S. Pat. No. 2,474,659 (Ebert) discloses a foldable display device and easel of substantially rectangular contour, which, when erected, rests on the lower edge of the surface for supporting visual material. The support surface is comprised of two panels which fold together via a transverse fold. Affixed to the rear surfaces of the support panels are four laterally extending hinged wings which swing out from the rear surface to provide structural stability.

U.S. Pat. No. 1,840,659 (Eburne) discloses a simple easel comprising an extending hinge member which swings laterally out and away from the rear surface of a picture or picture frame to support it substantially upright.

The above-described representative devices do not exhaust the possible list of disclosed collapsible supports, book holders, copy stands, and display easels and mounts. Other devices in the indicated or closely-related subject areas include: U.S. Pat. No. 5,165,649 (Neumann); U.S. Pat. No. 5,141,199 (Nemeth); U.S. Pat. No. 5,035,393 (Menaged); U.S. Pat. No. 4,722,504 (Degenholtz); U.S. Pat. No. 3,991,967 (Sack); U.S. Pat. No. 3,990,669 (Smith); U.S. Pat. No. 3,785,605 (Parekh); U.S. Pat. No. 3,473,777 (Ketterer); U.S. Pat. No. 2,992,500 (Hayhow); U.S. Pat. No. 2,533,874 (Burr); U.S. Pat. No. 2,375,190 (Botts); and U.S. Pat. No. 2,204,881 (Belleisle).

While the above-described and above-indicated structures and configurations provide partial solutions to the demands of potential users, none provide a completely satisfactory balance of the primary objectives. Clark, for example, does not provide a flat folded configuration and requires attachment of parts in its assembly. The present invention folds flat and does not require the attachment or detachment of parts in assembly and disassembly, respectively.

Choi, White, Raggiotti do not include any folds which increase the planar support surface area sufficient to support large open sheets of paper, and further do not fold into a configuration smaller than the planar support surface in the assembled configuration. The present invention provides both.

Smith provides a planar support surface with two vertical fold lines, and the device, in the folded configuration, comprises six layers of material thickness. The forwardly extending ledge, somewhat comparable to the shelf in the present invention, is not elevated and is not positioned at an approximately right angle relative to the support surface.

The present invention provides an elevated shelf at right angle to the support surface and folds into a compact and transportable, essentially planar surface of only four panels thickness.

Unlike the present invention, neither Viglietta nor Ebert have an elevated shelf to support reading or visual material, but only a base section which lies flat on an underlying surface; further, the fold lines in Viglietta and Ebert are transverse so as to provide additional height for the upright support, rather than vertical, so as to provide additional width, as in the present invention. Finally, Viglietta folds to a thickness of six sections, whereas the present invention folds to a four layer thickness.

Finally, Eburne is simply the well-known desktop picture frame easel. It does not provide a shelf to support reading material or sheet music, and it is not designed for portability or to fold into a highly compact configuration.

Many of the devices in the prior art entail numerous steps in the assembly (unfolding) process, while an embodiment of the present invention can be opened in either one continuous motion or in two to four short steps and without requiring the attachment or removal of parts. Many of the stands in the prior art are bulky and heavy even when disassembled or folded. In the present invention, no removal or attachment of separate parts is required, no separately operating parts need be manipulated, all of the parts are integrally formed, and all moving parts operate in coordination with one another. Many prior art devices have several component parts and many require tools for assembly and disassembly. The component parts of the subject invention interact so as to minimize the total number of parts. Additionally, when the device is fabricated of preferred materials, and when the stand is in its closed configuration, it is smaller and lighter in weight than a typical newsstand magazine, and consequently can be easily transported and stored. Moreover, devices in the prior art do not provide a support surface rigid enough and large enough to support open sheet music or an open book while also folding to approximately notebook paper size for convenient transport.

The present invention achieves these objectives in a superior fashion to the devices in the prior art.

SUMMARY OF THE INVENTION

In its simplest embodiment, the invention is constructed of four panels, two laterally extending wings which integrally form the feet and the angular portions which determine the angle at which the stand rests when open and maintains the shelf at substantially 90° to the back, and four flexible hinges. (Alternatively, the stand could be made of four or more non-flexible hinges.) Two of the panels constitute the largest portions of the stand. They can be of varying size, but are most advantageously sized slightly more or less than an 8½×11 inch sheet of paper and are preferably fabricated from lightweight, semi-rigid thin sheeted plastic, aluminum, or cardboard. The two largest panels are adjoined by a hinge along one contiguous edge. The next two panels are of much smaller dimension, being of the same or substantially the same width as the first two panels but of only roughly 1–2 inches in length, and fabricated from similar material as the first two panels. The third panel is joined to the first panel and the fourth panel is joined to the second panel, each by a hinge of comparable length to the contiguous edge of the adjoined first and second panels. The third and fourth panels are further joined to one another by a hinge which is contiguous with the hinge which adjoins the first and second panels. As such, the first hinge spans the length of the adjoined edges of the first and second panels plus the adjoined edges of the third and fourth panels. The device is opened or closed by opposing angular motion of the panels around the first hinge. The second hinge is situated and operates perpendicular to the first hinge so that the third and fourth panels are coplanar with the first and second panels when folded. The first and second panels may be moved into place at an approximately 90° angle to the first and second panels for use as a shelf to support reading or visual material when the device is opened into its operational configuration. The substantially 90° opposition of the shelf to the back locks both in the open position.

The two laterally extending wings or feet are affixed to the rear surface of the first and second panels, respectively, via a flexible (or, alternatively, non-flexible) hinge or hinges. When extended outward from the rear surface of the first and second panels and placed in the operative configuration, the wings engage the surface underlying the device and support the first and second panels in an angle appropriate for comfortable reading (e.g., 40 to 80 degrees) while simultaneously supporting the third and fourth panels in the shelf configuration described above.

DETAILED DESCRIPTION OF A PREFERRED EMBODIMENT

Figure 1:
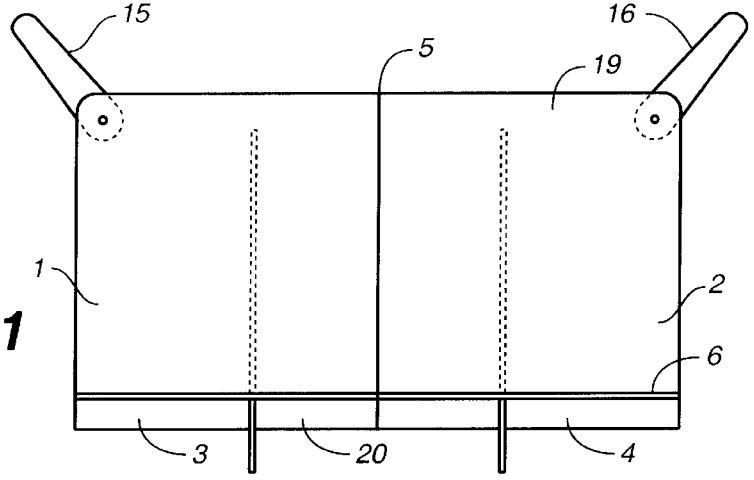
FIG. 1 is a front view of the first and simplest embodiment of the invention in the operational configuration.
Figure 2:
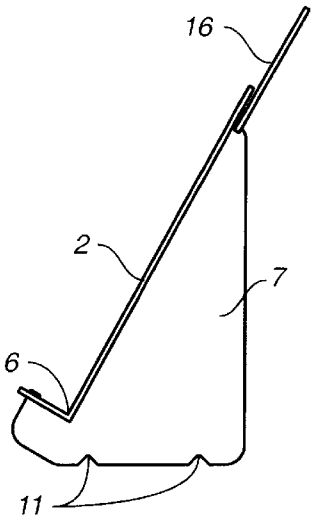
FIG. 2 is a side view of the same embodiment in the operational configuration.
Figure 3:
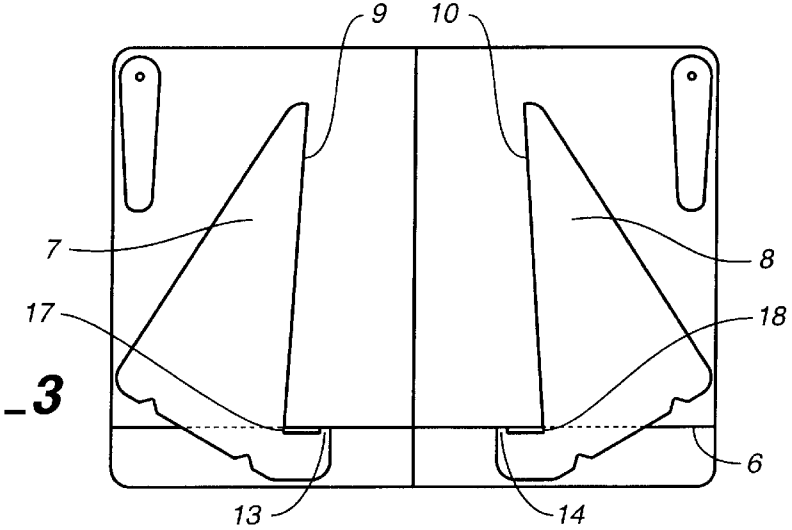
FIG. 3 is a rear view of the first embodiment opened along the first hinge but not yet placed in the operational configuration. In this figure, the shelf member and feet have not been placed in the operational configuration.
Figure 4:
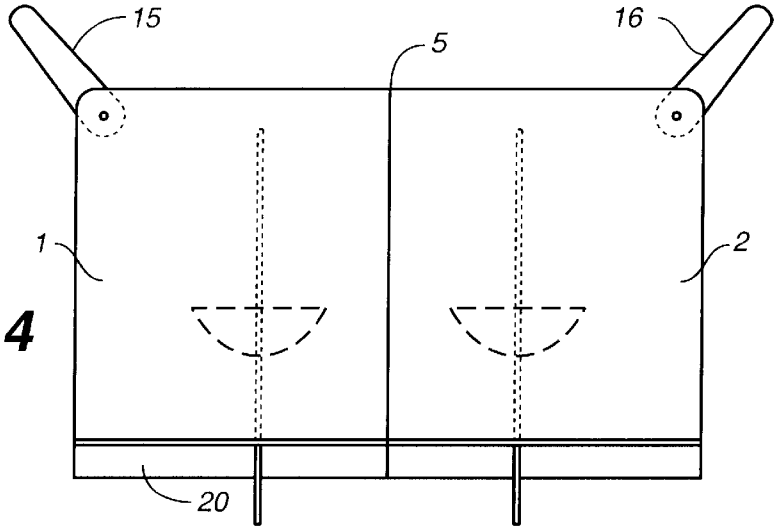
FIG. 4 is a front view of a second embodiment of the invention in the operational configuration.
Figure 5:
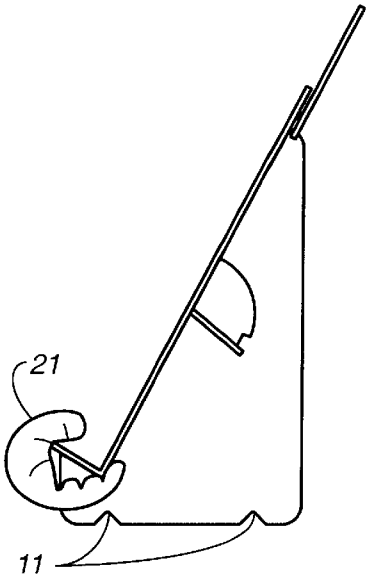
FIG. 5 is a side view of the second embodiment in the operational configuration.
Figure 6:
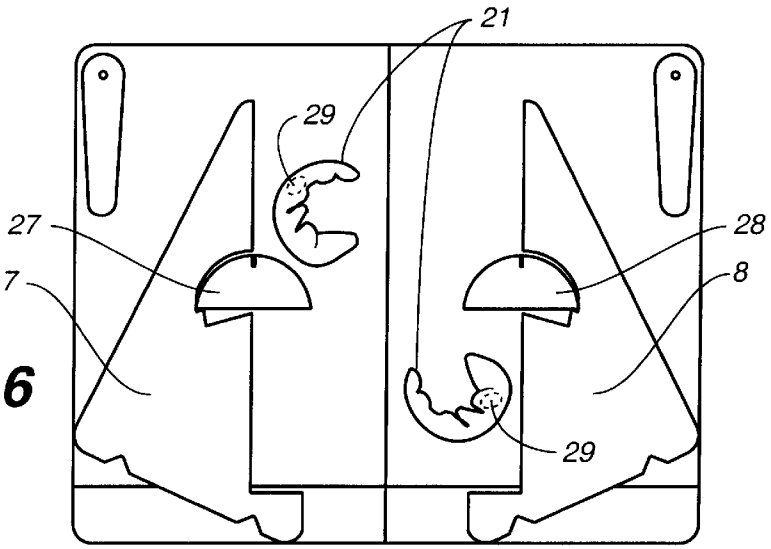
FIG. 6 is a rear view of the second embodiment opened along the first hinge. In this figure, the shelf member and feet have not yet been placed in the operational configuration.
Figure 8:
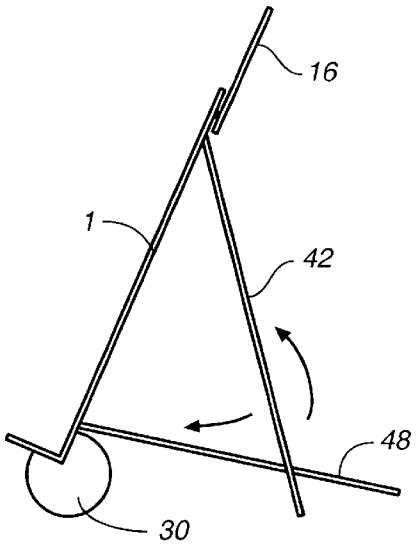
FIG. 8 is a side view of the third embodiment in the operational configuration.
Figure 7:
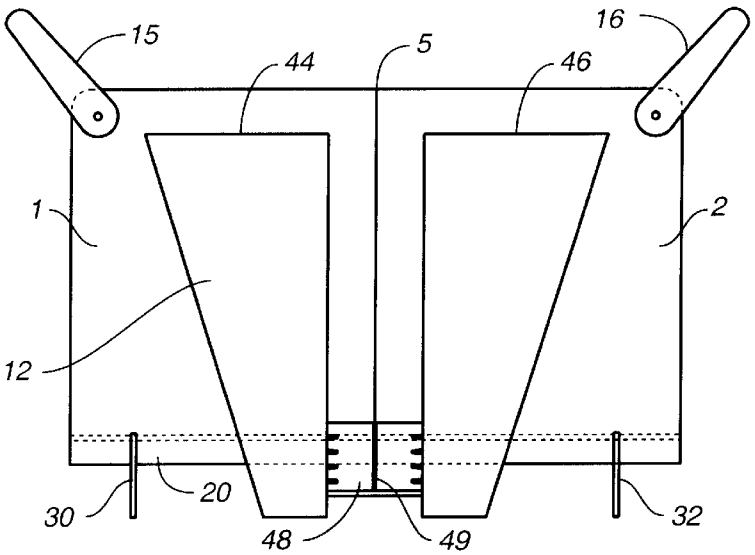
FIG. 7 is a rear view of a third embodiment of the invention in the operational configuration.
Figure 9:
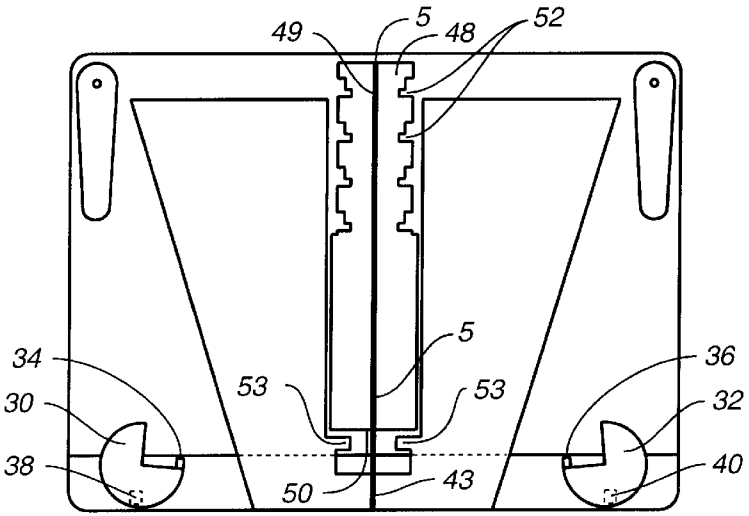
FIG. 9 is a view of the back of the third embodiment with the support member in the open configuration, but none of the other members in the operational configuration. The shelf member is coplanar with the support member and the feet members and hinged struts are laying flat against the support and shelf members, all of which have not been placed in the operational configuration.
Figure 11:
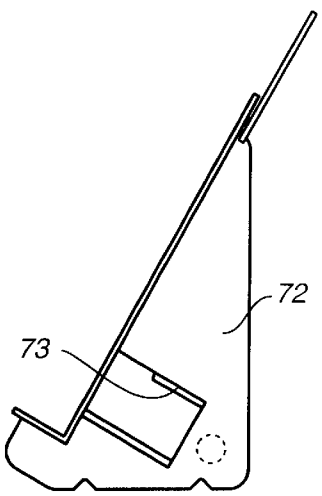
FIG. 11 is a side view of the fourth embodiment.
Figure 10:
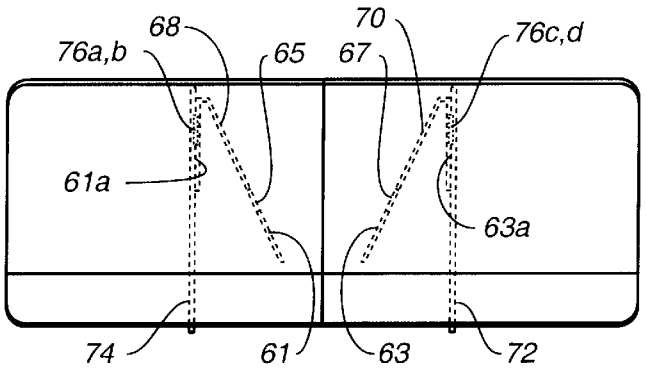
FIG. 10 is a top view of a fourth embodiment of the folding stand of the present invention in the operational configuration.
Figure 12:
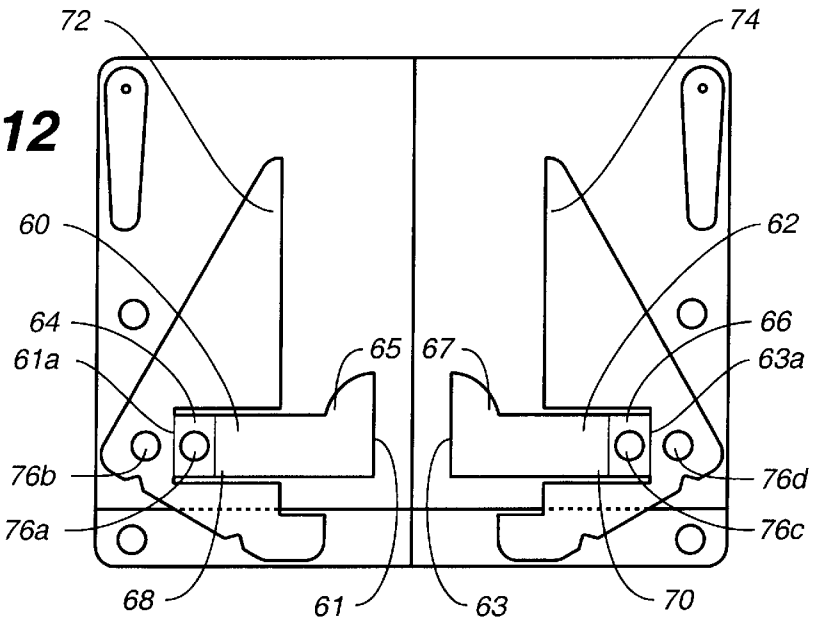
FIG. 12 is a view of the back of the fourth embodiment with the support member in the open configuration, but none of the other members in the operational configuration. The shelf member is coplanar with the support member and the feet members and hinged struts are laying flat against the support and shelf members.
Figure 13:
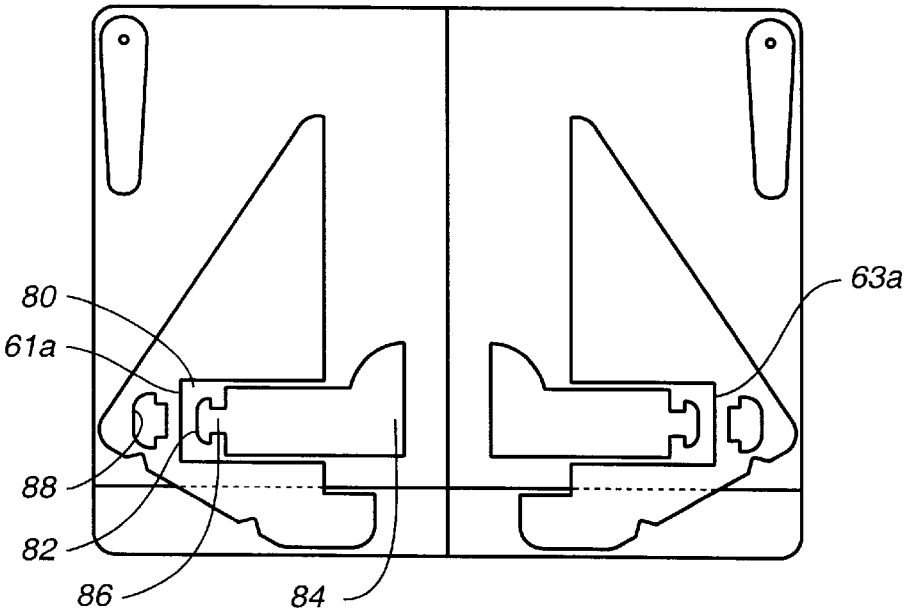
FIG. 13 is a view of the back of the fourth embodiment of the folding stand of the present invention, showing a variation on means for fastening the hinging strut to the feet member. This view shows the stand with the support member in the open configuration, but the shelf member is coplanar with the support member and all other members lay flat against the support member.
Figure 14:
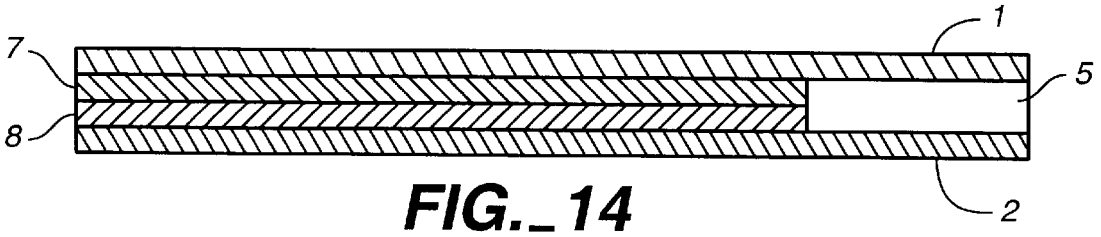
FIG. 14 shows the folding stand in the closed configuration.

FIGS. 1–3 show the first and simplest embodiment of the folding stand of the present invention. FIGS. 4–6 illustrate a second embodiment of the present invention. FIGS. 7–9 show a third embodiment. FIGS. 10–12 show a fourth embodiment. FIG. 13 illustrates a variation on the fourth embodiment. FIG. 14 shows the folding stand of the present invention in the closed configuration.

FIGS. 1–3, illustrating the first and simplest embodiment of the folding stand of the present invention, show that when the stand is opened along the first vertical hinge 5, the first two panels 1 and 2 form the support member 19, and the third and fourth panels, 3 and 4, form the shelf elevated member 20. When the device is opened along the first hinge 5, all of the panels are coplanar. The second hinge 6 is horizontal and can then be articulated to swing the shelf member 20 into place at a substantially right angle to the support member 19. The placement and operation of the horizontal hinge 6 perpendicular to that of the first hinge 5 prevents the hinges from operating simultaneously and gives the device rigidity. Furthermore, when the shelf member is in its operational position, the device cannot close.

FIGS. 1–3 also show a pair of laterally extending wings which constitute the feet members 7 and 8, which are affixed to the rear surfaces of the support member panels 1 and 2 via a third and fourth hinge 9 and 10, respectively. The bottom edges of the respective feet members 7 and 8 engage an underlying surface on which the entire device rests. The feet members form angular portions 17 and 18, which support the angle of the shelf member at substantially 90° to the support member, and feet members 7 and 8, which stabilize the device along its back side, and upon which the device rests upon a table top or other surface as described above. Additional support for oversize documents and papers may be provided, for each and every embodiment of the present invention, by first and second pivotally affixed extensions 15 and 16.

FIGS. 2 and 5 illustrate notches 11 formed in the feet members which are utilized to adjust the angle of the support member when the device is in use. The stand can be tilted and adjacent notches in each foot member placed against the edge of a book or similar object such that the stand will remain tilted. The feet members are of such dimension that the feet are disposed within the stand when the stand is in the closed position and extend below the shelf member when the shelf member is swiveled about the second hinge 6 to be placed to the support member.

The feet, 7 and 8, also have integrally formed tabs, 13 and 14, which engage with notches (not shown) cut into and through the shelf member. These further stabilize the device in its open position.

The second embodiment of the present invention, illustrated in FIGS. 4–6, is similar to the simplest embodiment with the added features of half-moon stabilizing members 27 and 28. These stabilizing members lie in the plane of the support member when the stand is not in use. When the stand is in use, the stabilizing members, feet members, and support members are all substantially perpendicular to one another, thereby constituting the three dimensional configuration of the stand.

In the third embodiment of the present invention, illustrated in FIGS. 7–9, the first and second foot members, 30 and 32 respectively, are substantially three-quarter circles, each having integral tabs 34 and 36 which couple with notches 38 and 40 integral in the shelf member when said members are moved into the operational configuration. An arm 42 is affixed with hinges 44 and 46 to the back of the support member and depends downwardly in the operational configuration to provide back support. The arm 42 has a hinge 43 at its base and lays flat against the support member so that it folds in coordination with other structure into the closed configuration. Additional structure includes a laterally extending strut 48 having a longitudinal hinge 49 running its length and further affixed by a hinge 50 to the back of the support member such that the strut member lies coplanar with said support member when the stand is in the closed configuration. The strut preferably includes integral notches 52 which engage the arm via tabs 53 to form a triangular support of various shapes in the operational configuration, and the angle of the stand in relation to the horizontal can thereby be adjusted when the stand is in the operational configuration.

A fourth embodiment illustrated in FIGS. 10–12 incorporates laterally extending collapsible strut members 60 and 62, each affixed to the rear surface of the support member panels, and each with a short distal portion 64 and 66 affixed to the proximal portion by a flexible hinge 68 and 70. When in the closed configuration, the struts lay superimposed on the rear surfaces of the support member panels, as shown in FIG. 12, the length of the struts accommodated by a conforming aperture 73 (shown in FIG. 11) in first and second foot members 72 and 74. When in the operational configuration, FIG. 10, the struts extend via hinges 61 and 63 laterally away from the rear surface of the support panels in coordination with the foot members via hinges 68 and 70 and attach to the foot member, for example with hook and loop fasteners 76, to lend the stand further support and to prevent the foot members from inadvertently swinging away from the ideal 90° relationship to the plane of the support member when the stand is in use.

A variation on the fourth embodiment, illustrated in FIG. 13, is operationally identical to the first variation of the fourth embodiment described in the immediately preceding paragraph and represents a slight, though preferable, modification in the operational configuration. In this design the proximal and distal portions of the collapsible strut members fit together like a puzzle in the closed configuration, the distal portion 80 including a female opening 82 and the proximal segment 84 including a male tab 86. The foot members include apertures 88 configured to couple or snap fit with the male tab on the strut members. In the closed configuration, the struts lay superimposed on the support members. When the struts are extended laterally away from the rear surface of the support panels in coordination with the foot members, the male tab of the struts engage and releasably connect to the foot members with a snap fit that may be readily disengaged for closing.

In any embodiment, to return the stand to its closed position, any tabs are disengaged, struts and feet are folded flat against the rear surface of the support member, and the shelf is returned to a coplanar relationship with the support member (see FIGS. 3, 6, 9, 12, and 13). The stand can now be closed along the central hinge 5, thereby nestling the feet 7 and 8 between the two panels, 1 and 2, to which they are affixed. FIG. 14 shows the stand in the closed configuration, particularly illustrating its low profile of only four panel layers of thickness, and further showing that in the closed configuration the stand comprises a surface area substantially one half of the surface area of the support member's surface area, or that of one of the panels, 1 and 2.

FIGS. 5 and 6 show a page holder 21 which may be used in connection with each and every embodiment of the present invention. The page holder is a substantially crescent shaped planar member with channels cut into its concave edge for adjustably positioning the page holder on the edge of the shelf member when the stand is in the operational configuration. The page holder is sized to retain the pages of a book and to fully wrap underneath the shelf member at any setting. It may be removed from the shelf member and attached to the back of the support member panels (for example, with hook and loop fasteners 29) when the stand is placed into the closed configuration.

Preferable materials for the stand include lightweight, semirigid thin sheeted plastic or aluminum. Other lightweight materials, such as cardboard, may be used, but are less desirable for long term use.

Any lightweight source of illumination, as well known in the art, may be attached to the stand to furnish light to the user.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed is:

1. A folding stand for use in supporting reading or visual material, said stand having a closed and an operational configuration, said stand comprising:

a support member, said support member having a surface area bifurcated into a first and a second panel by a first vertical hinge forming a fold line perpendicular to the longest dimension of said support member;

an elevated shelf connected to said support member by a horizontal hinge running substantially the length of the longest dimension of said support member and said elevated shelf, said elevated shelf bifurcated into a third and a fourth panel by a second vertical hinge forming a fold line contiguous with said fold line of said support member;

a first and a second foot member, each serving to provide angular support for said support member and said elevated shelf when the stand is in the operational configuration; and wherein the stand in the closed configuration comprises a thickness of no more than four panels and a surface area equal to one half of the surface area of the support member's surface area.

2. The folding stand of claim 1 wherein said first foot member is affixed to said first panel by a hinge, said second foot member is affixed to said second panel by a hinge, said first and second foot members lying flat against said panels when the stand is in the closed configuration and extending outward from said first and second panels at substantially a right angle when in the operational configuration.

3. The folding stand of claim 1 wherein said bottom edge of said first and second foot members each include one or more notches for supporting said first and second foot members against a book or similar object to support the stand in a tilted position.

4. The folding stand of claim 1, further comprising:

a first and second articulating strut affixed to the back side of said support member, said first and second struts each having proximal and distal ends and a fully extended configuration and a folded configuration such that said struts lie coplanar with said support member when the struts are in the extended configuration and the stand is in the closed configuration, and said struts are in the folded configuration when the stand is in the operational configuration;

a hinge connecting the proximal and distal portions of said first and second struts;

a hinge connecting said distal portion of said first strut to said first foot member;

a hinge connecting said distal portion of said second strut to said second foot member; and connection means whereby said first and second struts fasten to said first and second foot members when the stand is in the operational configuration.

5. The folding stand of claim 4, wherein said connection means comprises hook and loop fasteners.

6. The folding stand of claim 4 wherein said proximal portion of each of said first and second articulating struts has an integrally formed male tab, and said distal portion of each of said first and second articulating struts has a female aperture which mates with said male tab so that in the closed configuration said first and second struts lay superimposed on the back surface of said support members; and wherein said first and second foot members include apertures conformed to couple with said male tabs in the operational configuration.

7. A folding stand for use in supporting reading or visual material, said stand having a closed and an operational configuration, said stand comprising:

a support member, said support member having a surface area divided substantially in half into a first and a second panel by a first vertical hinge forming a fold line perpendicular to the longest dimension of said support member, said support member having a rear surface;

an elevated shelf connected to said support member by a horizontal hinge running substantially the length of the longest dimension of said support member and said elevated shelf, said elevated shelf divided substantially in half into a third and a fourth panel by second vertical hinge forming a fold line contiguous with said first vertical hinge forming the fold line of said support member;

an arm connected to said rear surface of said support member by a hinge, said arm divided substantially in half by a vertical base hinge comprising a third vertical hinge, said third vertical hinge aligned with said first and said second vertical hinges, said arm lying coplanar with said support member when the stand is in the closed configuration, said arm also having at least one tab;

a strut having a proximal and a distal end and connected at its proximal end to said rear surface of said support member, said strut divided substantially in half by a fourth vertical hinge aligned with said first through third vertical hinges, said strut including a plurality of notches at its distal end, said notches removably interlocking with said tabs of said arm when the stand is in the operational configuration, said arm and strut forming a variable triangle with one another when the stand is in the operational configuration; and wherein the stand in the closed configuration comprises a thickness of no more than four panels and a surface area equal to one half of the surface area of the support member's surface area.

8. The folding stand of claim 7 further comprising a first and second support extension, each pivotally affixed to the rear surface of said support member.

9. A folding stand for use in supporting reading or visual material, comprising:

a plurality of semi-rigid panels and flexible hinges, the panels and hinges in moving relation with one another such that the stand may be placed in either a closed or an operational configuration, the stand in the configuration having a support member, an elevated shelf, and first and second foot members, said support member and elevated shelf having surface areas each bifurcated by a single contiguous fold line perpendicular to the longest dimension of the elevated shelf, said elevated shelf connected to said support member by a hinge running substantially the length of the longest dimension of each of said support member and said elevated shelf, said first and second foot members serving to provide angular support for said support member while simultaneously said elevated shelf, the stand in the closed configuration comprising a thickness of no more than four panels lying superimposed on one another and comprising a surface area substantially one half of the surface area of the support member's surface area; and first and second page holders, said page holders being generally planar and having a substantially crescent shape with notches cut into the concave edge of each of said page holder for removably attaching to said shelf member such that said page holders are adjustable and accommodate varying sizes of materials placed on said stand in the operational configuration.

10. A folding stand for use in supporting reading or visual material, comprising:

a first and second panel, the first and second panels each comprising a front side, a back side, an inner edge and a bottom edge;

a first flexible hinge, said first and second panels adjoined along their respective inner edges via the first hinge;

an operational configuration and a closed configuration;

a support member comprised of said first and second panels and said first hinge, said first and second panels contiguous and lying in the same plane when the stand is in the operational configuration, the back side of said first panel facing the back side of said second panel when the stand is in the closed configuration;

a first and second brace member, said first and second brace members pivotally attached to the back side of said first and second panels, respectively;

a third and fourth panel, said third and fourth panels each having a top side, a bottom side and inner edge and an upper edge, said third and fourth panels adjoined to one another along their respective inner edges via said first hinge, said third and fourth panels substantially coplanar with the first and second panels respectively when the stand is in the closed configuration;

a second flexible hinge adjoining the upper edges of said third and fourth panels to the bottom edges of said first and second panels, said second hinge operating in a direction perpendicular to that of said first hinge such that the first and second hinge cannot operate at the same time;

a shelf comprised of said third and fourth panels and second hinge, said shelf in pivotal relationship to the support member when the support member is opened along said first hinge, said shelf substantially perpendicular to the support member when the stand is in the operational configuration;

a first and second foot member;

a third and a fourth hinge, said first foot member affixed to the back side of said first panel via the third hinge and said second foot member affixed to the back side of the second panel via the fourth hinge, said first and second foot members in the same plane as the first and second panels when the stand is in the closed configuration and substantially perpendicular to said first and second panels when the stand is in the open configuration;

a first and second angular portion, said first angular portion formed integrally with said first foot member, said second angular portion formed integrally with said second foot member, said angular portions of substantially a 90 degree angle, said angular portion positioned at less than a 90 degree angle to the horizontal such that the front side of the support member is at a substantially 90 degree angle to the shelf member and the back side of the support member is less than 90 degrees to the horizontal and the bottom side of the shelf is less than 90 degrees to the surface on which the device rests and the shelf and the support member rest within the angular portions when the stand is in the operational configuration at an angle which is desirable for supporting materials;

a fifth and sixth hinge;

a first and second laterally extending semicircular stabilizing member, each of said first and second semicircular stabilizing member affixed to the rear surface of said first and second panels, respectively, via said fifth and sixth hinges, respectively, said stabilizing members each notched at the apex of the semicircular arc so as to be removably interconnected with the interior edge of its corresponding foot member when the stand is in its operational configuration, thereby providing structural support to said foot members, and positioned at a substantially right angle to the plane of the support member when in the operational configuration, and laying superimposed on the rear surface of said first and second panels in the closed configuration.

* * * * *